US011286623B2

(12) United States Patent
Sachs et al.

(10) Patent No.: US 11,286,623 B2
(45) **Date of Patent: *Mar. 29, 2022**

(54) SINGLE PLY TISSUE HAVING IMPROVED CROSS-MACHINE DIRECTION PROPERTIES

(71) Applicant: Kimberly-Clark Worldwide, Inc., Neenah, WI (US)

(72) Inventors: Mark W. Sachs, Appleton, WI (US); Richard A. Zanon, Appleton, WI (US); Lynda E. Collins, Neenah, WI (US); Kevin J. Vogt, Neenah, WI (US); Christopher L. Satori, Hortonville, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/007,375

(22) Filed: Aug. 31, 2020

(65) Prior Publication Data

US 2022/0064863 A1 Mar. 3, 2022

(51) Int. Cl.
*D21H 27/00* (2006.01)

(52) U.S. Cl.
CPC ..... *D21H 27/005* (2013.01)

(58) Field of Classification Search
CPC .... D21H 27/005; D21H 27/008; D21H 27/40; D21F 11/006
See application file for complete search history.

(56) References Cited

U.S. PATENT DOCUMENTS

| | | | |
|---|---|---|---|
| 4,440,597 | A | 4/1984 | Wells et al. |
| 4,638,907 | A | 1/1987 | Bedenk et al. |
| 5,591,309 | A | 1/1997 | Rugowski et al. |
| 5,607,551 | A | 3/1997 | Farrington et al. |

(Continued)

FOREIGN PATENT DOCUMENTS

| | | |
|---|---|---|
| EP | 0625610 B1 | 11/1999 |
| WO | 0008253 A1 | 2/2000 |

(Continued)

OTHER PUBLICATIONS

Tissue360.tappi, "Sheet Structure Process Effect on Tissue Properties", https://tissue360.tappi.org/.

(Continued)

*Primary Examiner* — Eric Hug
*Assistant Examiner* — Matthew M Eslami
(74) *Attorney, Agent, or Firm* — Kimberly-Clark Worldwide, Inc.

(57) ABSTRACT

Provided are tissue webs, and products produced therefrom, that are generally durable, flexible and have improved cross-machine direction (CD) properties, such as CD tensile energy absorption (CD TEA), CD stretch and CD modulus. The inventive tissue products generally comprise a single tissue ply that has been prepared by through-air drying and more preferably by through-air drying without creping. Moreover, the products may be produced using a transfer fabric positioned between the forming fabric and the through-air drying fabric where the transfer fabric imparts the nascent web with a high degree of CD strain.

20 Claims, 5 Drawing Sheets

(56) References Cited

U.S. PATENT DOCUMENTS

| | | | |
|---|---|---|---|
| 5,656,132 | A | 8/1997 | Farrington et al. |
| 5,672,248 | A | 9/1997 | Wendt et al. |
| 5,746,887 | A | 5/1998 | Wendt et al. |
| 5,772,845 | A | 6/1998 | Farrington et al. |
| 5,830,321 | A | 11/1998 | Lindsay et al. |
| 6,017,417 | A | 1/2000 | Wendt et al. |
| 6,585,856 | B2 | 7/2003 | Zwick et al. |
| 6,827,818 | B2 | 12/2004 | Farrington, Jr et al. |
| 6,887,348 | B2 | 5/2005 | Hermans et al. |
| 6,893,535 | B2 | 5/2005 | Hermans et al. |
| 7,166,189 | B2 | 1/2007 | Burazin et al. |
| 7,294,229 | B2 | 11/2007 | Hada et al. |
| 7,399,378 | B2 | 7/2008 | Edwards et al. |
| 7,497,925 | B2 | 3/2009 | Hermans et al. |
| 7,611,605 | B2 | 11/2009 | Burazin et al. |
| 7,726,349 | B2 | 6/2010 | Mullally et al. |
| 7,828,932 | B2 | 11/2010 | Hermans et al. |
| 7,935,220 | B2 | 5/2011 | Edwards et al. |
| 7,935,221 | B2 | 5/2011 | Allen et al. |
| 7,935,409 | B2 | 5/2011 | Burazin et al. |
| 7,938,932 | B2 | 5/2011 | Hermans et al. |
| 7,972,474 | B2 | 7/2011 | Underhill et al. |
| 8,481,133 | B2 | 7/2013 | Hermans et al. |
| 8,574,399 | B2 | 11/2013 | Hermans et al. |
| 8,652,597 | B2 | 2/2014 | Hermans et al. |
| 8,852,398 | B2 | 10/2014 | Hermans et al. |
| 8,940,376 | B2 | 1/2015 | Stage et al. |
| 8,956,503 | B2 | 2/2015 | Hermans et al. |
| 9,222,224 | B2 | 12/2015 | Shannon |
| 10,161,084 | B2 | 12/2018 | Burazin et al. |
| 2003/0136529 | A1 | 7/2003 | Burazin et al. |
| 2004/0118544 | A1 | 6/2004 | Tirimacco et al. |
| 2004/0200590 | A1 | 10/2004 | Wilhelm |
| 2005/0133175 | A1 | 6/2005 | Hada et al. |
| 2005/0145352 | A1 | 7/2005 | Hermans et al. |
| 2005/0145353 | A1 | 7/2005 | Troxell et al. |
| 2005/0148257 | A1 | 7/2005 | Hermans et al. |
| 2005/0161179 | A1 | 7/2005 | Hermans et al. |
| 2005/0236122 | A1 | 10/2005 | Mullally et al. |
| 2005/0241786 | A1 | 11/2005 | Edwards et al. |
| 2006/0086472 | A1 | 4/2006 | Hermans et al. |
| 2006/0130986 | A1 | 6/2006 | Flugge-Berendes et al. |
| 2007/0000629 | A1 | 1/2007 | Tirimacco et al. |
| 2007/0131366 | A1* | 6/2007 | Underhill ..... D21F 11/14 162/109 |
| 2007/0137807 | A1 | 6/2007 | Schulz et al. |
| 2008/0073047 | A1 | 3/2008 | Bakken et al. |
| 2009/0065160 | A1 | 3/2009 | Hermans et al. |
| 2009/0194244 | A1 | 8/2009 | Harper et al. |
| 2010/0051217 | A1* | 3/2010 | Allen ..... D21G 1/00 162/116 |
| 2011/0155337 | A1 | 6/2011 | Murray et al. |
| 2012/0247698 | A1 | 10/2012 | Murray et al. |
| 2013/0160960 | A1* | 6/2013 | Hermans ..... D21H 27/005 162/205 |
| 2014/0118544 | A1 | 5/2014 | Asaka et al. |
| 2014/0209264 | A1 | 7/2014 | Tirimacco et al. |
| 2017/0049280 | A1 | 2/2017 | Weaver et al. |
| 2018/0135248 | A1* | 5/2018 | Collins ..... D21H 11/12 |
| 2018/0142421 | A1 | 5/2018 | Rouse et al. |
| 2018/0195239 | A1 | 7/2018 | Ziegenbein |
| 2018/0334778 | A1 | 11/2018 | Shannon et al. |
| 2019/0127919 | A1 | 5/2019 | Burazin et al. |
| 2019/0264395 | A1 | 8/2019 | Rouse et al. |
| 2020/0173114 | A1 | 6/2020 | Vogt et al. |
| 2020/0270812 | A1 | 8/2020 | Holz et al. |
| 2021/0140119 | A1 | 5/2021 | Vogt et al. |
| 2021/0207327 | A1 | 7/2021 | Margo Moreno et al. |
| 2021/0321831 | A1 | 10/2021 | Vogt et al. |
| 2022/0010496 | A1 | 1/2022 | Tirimacco et al. |

FOREIGN PATENT DOCUMENTS

| | | | |
|---|---|---|---|
| WO | 07078562 | A2 | 7/2007 |
| WO | 10023616 | A2 | 3/2010 |
| WO | 13041989 | A2 | 3/2013 |

OTHER PUBLICATIONS

Co-Pending U.S. Appl. No. 17/007,365, filed Aug. 31, 2020, by Sachs et al. for "Single Ply Tissue Having Improved Cross-Machine Direction Properties."

Co-Pending U.S. Appl. No. 17/007,394, filed Aug. 31, 2020, by Sachs et al. for "Multi-Ply Tissue Products Having Improved Cross-Machine Direction Properties."

* cited by examiner

SINGLE PLY TISSUE HAVING IMPROVED CROSS-MACHINE DIRECTION PROPERTIES

BACKGROUND

Generally, papermakers, particularly manufacturers of low basis weight tissue products, have attempted to improve product softness and durability by altering certain machine and cross-machine direction properties such as tensile strength, stretch and modulus. Of particular interest are cross-machine direction (CD) properties, such as CD tensile energy absorption (CD TEA), CD stretch and CD modulus, because tissue products are typically weakest in the cross-machine direction and most in-use failures occur in this direction. For example, U.S. Pat. No. 7,972,474 to Underhill sought to improve CD properties by manufacturing tissue products using a through-air drying process in which the transfer fabric and the through-air drying fabric were both textured fabrics having a substantially uniform high strain distribution in the cross-machine direction. The resulting tissue products, while having improved cross-machine direction properties such as low modulus and relatively high stretch, were relatively weak in the cross-machine direction, such as CD tensile strengths less than about 600 g/3".

In other instances, tissue makers have altered manufacturing processes to produce products having low degrees of CD modulus. While a low modulus may reduce the perception of the tissue as being stiff, at some point a low CD modulus may be interpreted as indicative of a weak or "flimsy" tissue. This is particularly true when low CD modulus is accompanied by a relatively low CD tensile strength, such as less than about 600 g/3". Thus, in certain instances tissue makers have attempted to increase CD modulus at a given tensile strength. For example, U.S. Pat. No. 7,300,543 to Mullally utilized papermaking fabrics with deep discontinuous pockets in an uncreped through-air dried tissue process to produce tissue products having the desired CD slope values. Similarly, U.S. Pat. No. 8,500,955 to Hermans attempted to improve CD slope at a given CD tensile strength by rewetting the dried tissue web, pressing the rewetted web and then drying the web for a second time.

While tissue makers have been able to modulate certain cross-machine properties they have not succeeded in balancing all of the properties to produce a tissue product that has sufficient strength to withstand use but is also soft and pliable. Therefore, there remains a need in the art for tissue webs and products having balanced cross-machine direction properties and methods of manufacturing the same.

SUMMARY

The present invention provides tissue webs, and products produced therefrom, that are generally durable, flexible and have improved cross-machine direction (CD) properties, such as CD tensile energy absorption (CD TEA), CD stretch and CD modulus, measured as CD Slope. The inventive products comprise a single ply tissue web, preferably webs prepared by through-air drying and more preferably by through-air drying without creping, commonly referred to uncreped through-air dried (UCTAD).

In one particularly preferred embodiment the tissue webs of the present invention are manufactured by transferring a partially dewatered web to a transfer fabric, particularly a highly structured transfer fabric, that molds the partially dewatered web prior to it being transferred to a through-air drying fabric. Surprisingly, molding imparted by the transfer fabric is retained in the dried web the resulting tissue products have improved physical properties such as CD TEA, CD stretch and CD modulus, measured as CD Slope.

In other embodiments the present invention provides a single ply tissue product having a CD stretch of about 14.0 percent or greater, such as about 15.0 percent or greater, such as about 16.0 percent or greater, such as from about 14.0 to about 18.0 percent, such as about 15.0 to about 17.0 percent. Surprisingly, the foregoing CD Stretch values may be achieved without creping the tissue web. Rather than crepe the web during manufacture, the instant tissue products may be produced by transferring a partially dewatered web to a transfer fabric having a high degree of topography to strain the nascent sheet in the cross-machine direction.

In other embodiments the present invention provides a through-air dried single ply tissue product having a CD tensile strength of about 2,200 g/3" or greater, such as from about 2,200 to about 2,500 g/3", and a CD stretch from about 14.0 to about 17.0 percent.

In another embodiment tissue products of the present invention have sufficient strength to maintain integrity in-use but are flexible and soft. For example, the products may have a geometric mean tensile strength (GMT) from about 2,000 to about 2,500 g/3" and a Stiffness Index less than about 5.0. In particularly preferred embodiments the products may have relatively low CD modulus, such as a CD Slope of about 4.5 kg or less, such as from about 3.0 to about 4.5 kg.

In still other embodiments the inventive tissue products are able to absorb a large amount of energy in the cross-machine direction before rupturing. For example, the inventive tissue products may have a high degree of CD Stretch, such as from about 14.0 to about 18.0 percent and a CD TEA of about 18.0 $g \cdot cm/cm^2$ or greater, such as about 18.0 to about 21.0 $g \cdot cm/cm^2$, and a Stiffness Index less than about 5.0.

In still other embodiments the present invention provides a method of manufacturing a single ply tissue product having improved cross-machine direction properties comprising the steps dispersing papermaking fibers in water to form an aqueous suspension of fibers; depositing the aqueous suspension of fibers on a forming fabric to form a wet tissue web; partially dewatering the wet tissue web; transferring the partially dewatered tissue web to a transfer fabric having CD strain from about 15 to about 19 percent; transferring the molded tissue web to a through-air drying fabric and conveying the tissue web over a dryer while supported by the through-air drying fabric to dry the tissue web to a consistency of at least about 95 percent.

In yet other embodiments the present invention provides a method of manufacturing a single ply tissue product comprising the steps of dispersing papermaking fibers in water to form an aqueous suspension of fibers; depositing the aqueous suspension of fibers on a forming fabric to form a wet tissue web; partially dewatering the wet tissue web; transferring the partially dewatered tissue web to a transfer fabric having CD strain from about 15 to about 19 percent; transferring the molded tissue web to a through-air drying fabric; and conveying the tissue web over a dryer while supported by the through-air drying fabric to dry the tissue web to a consistency of at least about 95 percent.

In another embodiment the present invention provides a method of making a through-air dried tissue sheet comprising depositing an aqueous suspension of papermaking fibers onto a forming fabric to form a wet web; dewatering the wet web to yield a partially dewatered web having a consistency from about 20 to about 30 percent; transferring the partially dewatered web to a woven transfer fabric having a plurality of interwoven shute and warp filaments, the transfer fabric having a web contacting surface and an opposite machine contacting surface, the web contacting surface comprising a plurality of spaced apart machine direction (MD) oriented protuberances defining a plurality of valleys having a valley bottom surface plane there between, the transfer fabric having a CD strain from about 15 to about 19 percent; transfer from the transfer fabric to a through-air drying fabric; and through-air drying the web to yield a through-air dried tissue web.

DEFINITIONS

Figure 1:
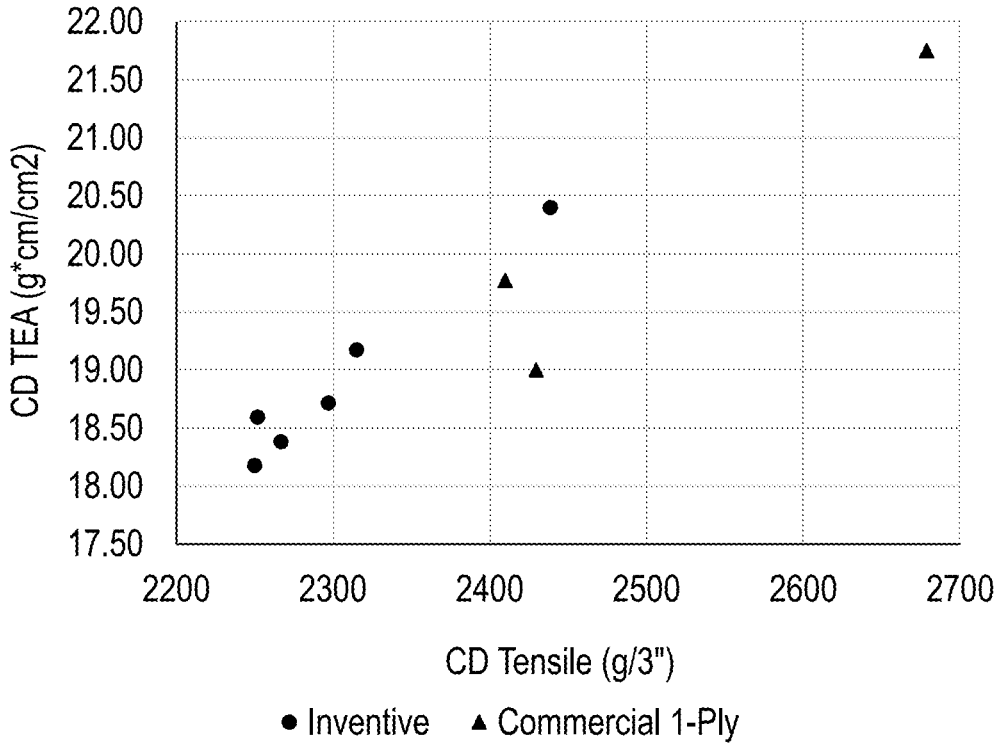
FIG. 1 is a graph of geometric mean tensile (x-axis) versus CD Stretch (y-axis) for inventive (●) and commercial (▲) tissue products.

As used herein the term "Basesheet" refers to a tissue web formed by any one of the papermaking processes described herein that has not been subjected to further processing, such as embossing, calendering, treatment with a binder or softening composition, perforating, plying, folding, or rolling into individual rolled products.

As used herein the term "Tissue Product" refers to products made from basesheets and includes, bath tissues, facial tissues, paper towels, industrial wipers, foodservice wipers, napkins, medical pads, and other similar products.

As used herein the term "Ply" refers to a discrete tissue web used to form a tissue product. Individual plies may be arranged in juxtaposition to each other. In a preferred embodiment, tissue products prepared according to the present invention comprise a single ply.

As used herein, the term "Layer" refers to a plurality of strata of fibers, chemical treatments, or the like, within a ply. A "Layered Tissue Web" generally refers to a tissue web formed from two or more layers of aqueous papermaking furnish. In certain instances, the aqueous papermaking furnish forming two or more of the layers comprises different fiber types.

As used herein the term "Machine Direction" (MD) generally refers to the direction in which a tissue web or product is produced. The term "Cross-Machine Direction" (CD) refers to the direction perpendicular to the machine direction.

As used herein, the term "Papermaking Fabric" means any fabric useful in the manufacture of a fibrous structure, such as a tissue sheet, typically by a wet-laid process. Specific papermaking fabrics within the scope of this invention include transfer fabrics for conveying a wet web from one papermaking step to another, such as described in U.S. Pat. No. 5,672,248 and through-air drying fabric for supporting a web as it is transported over one or more through-air dyers, such as described in U.S. Pat. Nos. 5,429,686, 6,808,599 and 6,039,838.

As used herein the term "Machine Direction Oriented" when referring to a protuberance on a papermaking fabric generally means that the element or protuberance's principle axis of orientation is positioned at an angle of less than about 20 degrees relative to the machine direction (MD) axis of the fabric or tissue sheet.

As used herein the term "Cross-Machine Direction Oriented" when referring to a protuberance on a papermaking fabric generally means that the element or protuberance's principle axis of orientation is positioned at an angle of greater than about 20 degrees relative to the machine direction (MD) axis of the fabric or tissue sheet. For example, a discrete, nonwoven protuberance disposed on the web contacting surface of a papermaking fabric having an element angle greater than 20 degrees, such as from 20 to about 40 degrees, may be said to be cross-machine direction oriented.

As used herein, the term "Protuberance" generally refers to a three-dimensional element disposed on the web contacting surface of a papermaking fabric. For example, in one embodiment, a protuberance may be formed by one or more warp filaments overlaying a plurality of shute filaments. In other instances, a protuberance may be a nonwoven material disposed on the web contacting surface of the fabric.

As used herein, the term "Valley" generally refers to a portion of a papermaking fabric that lies below the uppermost surface plane of the fabric and is generally bounded by a pair of spaced apart protuberances.

As used herein the term "Basis Weight" generally refers to the conditioned weight per unit area of a tissue and is generally expressed as grams per square meter (gsm). Basis weight is measured as described in the Test Methods section below. While the basis weights of tissue products prepared according to the present invention may vary, in certain embodiments the products have a basis weight of about 30 gsm or greater, such as about 34 gsm or greater, such as about 36 gsm or greater, such as from about 30 to about 42 gsm, such as from about 32 to about 40 gsm, such as from about 34 to about 38 gsm.

As used herein, the term "Caliper" refers to the thickness of a tissue product, web, sheet or ply, typically having units of microns (μm) and is measured as described in the Test Methods section below.

As used herein, the term "Sheet Bulk" refers to the quotient of the caliper (μm) divided by the basis weight (gsm) and having units of cubic centimeters per gram (cc/g). Tissue products prepared according to the present invention may, in certain embodiments, have a sheet bulk of about 10 cc/g or greater, such as from about 12 to about 20 cc/g, such as from about 14 to about 20 cc/g.

As used herein, the term "Slope" refers to the slope of the line resulting from plotting tensile versus stretch and is an output of the MTS TestWorks™ in the course of determining the tensile strength as described in the Test Methods section herein. Slope typically has units of kilograms (kg) and is measured as the gradient of the least-squares line fitted to the load-corrected strain points falling between a specimen-generated force of 70 to 157 grams (0.687 to 1.540 N).

As used herein, the term "Geometric Mean Slope" (GM Slope) generally refers to the square root of the product of machine direction slope and cross-machine direction slope. While the GM Slope may vary amongst tissue products prepared according to the present invention, in certain embodiments, tissue products may have a GM Slope less than about 5.00 kg, such as less than about 4.75 kg, such as less than about 4.50, such as from about 3.00 to about 5.00 kg.

As used herein, the term "Geometric Mean Tensile" (GMT) refers to the square root of the product of the machine direction tensile strength and the cross-machine direction tensile strength of the web. The GMT of tissue products prepared according to the present invention may vary, however, in certain instances the GMT may be about 2,000 g/3" or greater, such as about 2,200 g/3" or greater, such as about 2,400 g/3" or greater, such as from about 2,000 to about 2,600 g/3", such as from about 2,200 to about 2,500 g/3"

As used herein, the term "Stiffness Index" refers to the quotient of the geometric mean tensile slope, defined as the square root of the product of the MD and CD slopes (having units of kg), divided by the geometric mean tensile strength (having units of grams per three inches).

$$\text{Stiffness Index} = \frac{\sqrt{MD\ \text{Tensile Slope (kg)} \times CD\ \text{Tensile Slope (kg)}}}{GMT\ (\text{g}/3'')} \times 1{,}000$$

While the Stiffness Index of tissue products prepared according to the present invention may vary, in certain instances the Stiffness Index may be about 5.0 or less, such as about 4.5 or less, such as about 4.0 or less, such as from about 3.5 to about 5.0.

As used herein, the term "TEA Index" refers to the geometric mean tensile energy absorption (having units of g·cm/cm$^2$) at a given geometric mean tensile strength (having units of grams per three inches) as defined by the equation:

$$TEA\ \text{Index} = \frac{GM\ TEA(\text{g}\cdot\text{cm}/\text{cm}^2)}{GMT(\text{g}/3'')} \times 1{,}000$$

While the TEA Index may vary, in certain instances tissue products prepared according to the present invention have a TEA Index of about 10.0 or greater, such as about 11.0 or greater, such as about 12.0, or greater, such as from about 10.0 to about 13.0, such as from about 11.0 to about 13.0.

DETAILED DESCRIPTION

In general, the present disclosure is directed to tissue webs, and products produced therefrom, having improved cross-machine direction (CD) properties. In particularly preferred embodiments the tissue webs are converted into single ply tissue products and more particularly rolled tissue products comprising a single ply tissue spirally wound about a core. The single ply webs and products are generally durable, flexible and have improved CD properties, such as improved CD tensile energy absorption (CD TEA), CD stretch and CD modulus.

For example, in certain embodiments, the invention provides single ply tissue products having a CD stretch of about 14.0 percent or greater, such as about 15.0 percent or greater, such as about 16.0 percent or greater, such as from about 14.0 to about 18.0 percent. Surprisingly, the foregoing levels of CD stretch may be achieved without creping and at relatively high degrees of CD tensile strength, such as about 2,000 g/3" or greater, more preferably about 2,200 g/3" or greater and still more preferably about 2,300 g/3" or greater, such as from about 2,000 to about 2,600 g/3", such as from about 2,200 to about 2,500 g/3".

In other embodiments the tissue products of the present invention have good durability in the cross-machine direction, such as a CD TEA of about 18.0 g·cm/cm$^2$ or greater, such as about 19.0 g·cm/cm$^2$ or greater, such as from about 18.0 to about 21.0 g·cm/cm$^2$. The foregoing CD TEA values may be achieved at CD tensile strengths of about 2,000 g/3" or greater, more preferably about 2,200 g/3" or greater and still more preferably about 2,300 g/3" or greater, such as from about 2,000 to about 2,600 g/3", such as from about 2,200 to about 2,500 g/3". In this manner, the inventive tissue products may have a CD TEA Index of about 8.0 or greater, such as from about 8.0 to about 10.0.

Figure 2:
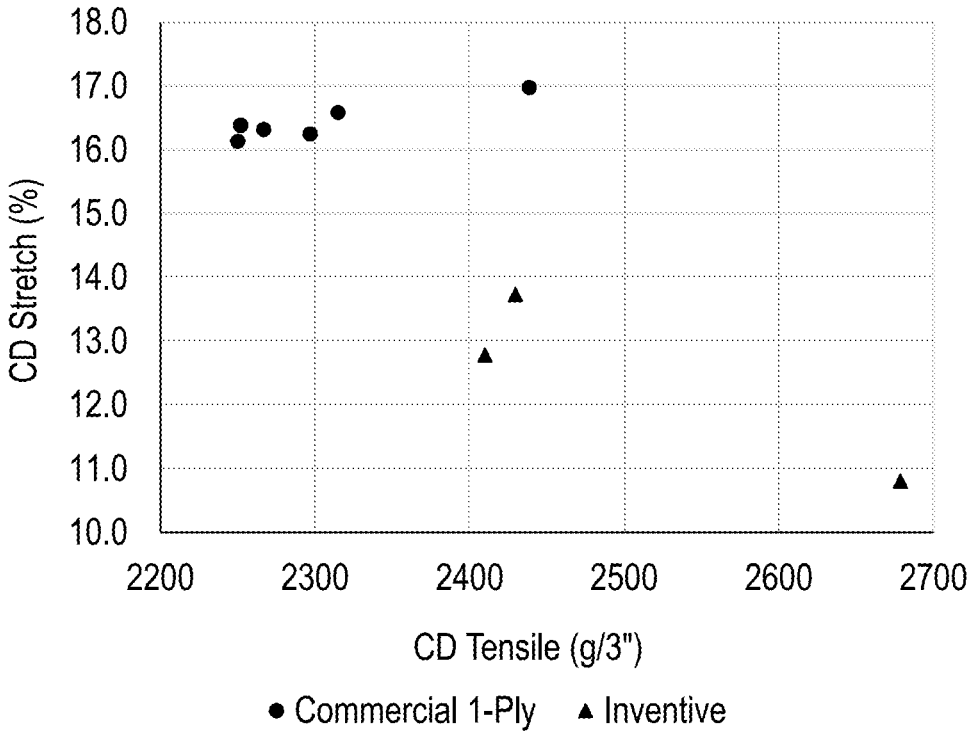
FIG. 2 is a graph of CD tensile (x-axis) versus CD Slope (y-axis) for inventive (●) and commercial (▲) tissue products.
Figure 3:
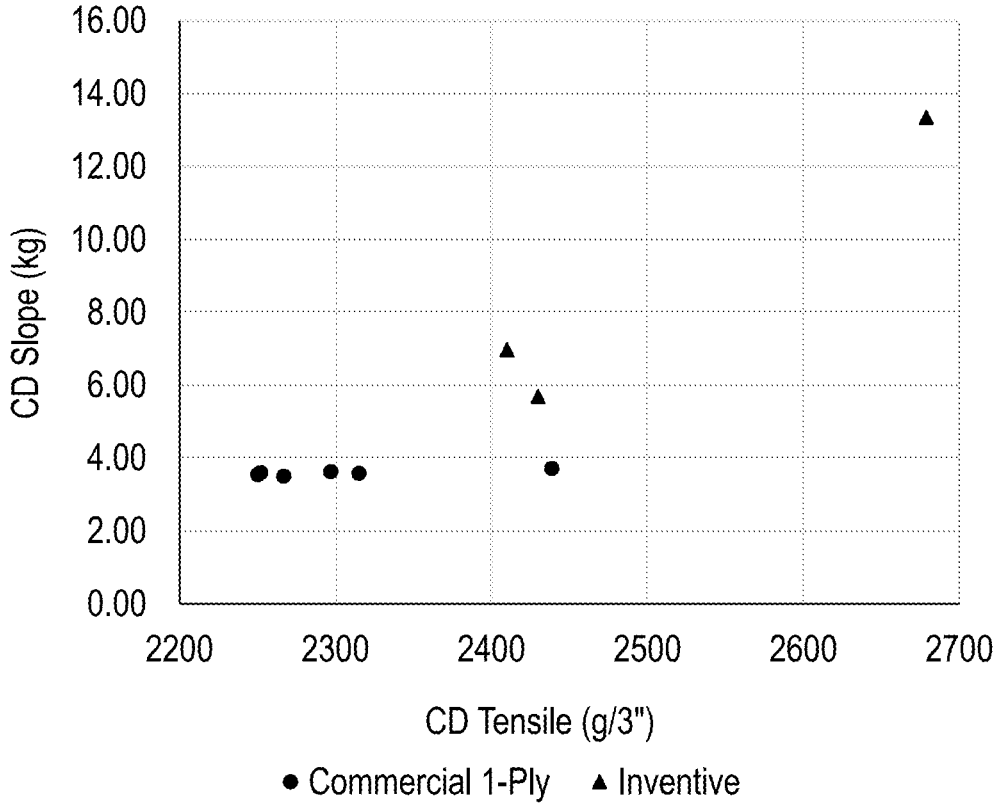
FIG. 3 is a graph of CD tensile (x-axis) versus CD Slope (y-axis) for inventive (●) and commercial (▲) tissue products.

A comparison of the CD properties of several inventive and commercially available tissue products may be found in Table 1, below. Compared to commercially available tissue products, the inventive tissue products have a high degree of CD stretch, low CD slope and a relatively high degree of CD tensile strength. These differences are further illustrated in FIGS. 1-3.

TABLE 1

| Description | Plies | TAD | Creped | GMT (g/3") | CD Tensile (g/3") | CD TEA (g · cm/cm$^2$) | CD Slope (g/3") | CD Stretch (%) |
|---|---|---|---|---|---|---|---|---|
| Viva Vantage | 1 | Y | N | 2443 | 2679 | 21.75 | 13.35 | 10.8 |
| Scott Towel | 1 | Y | N | 2432 | 2410 | 19.77 | 6.98 | 12.8 |
| Scott Towel | 1 | Y | N | 2438 | 2430 | 19.00 | 5.69 | 13.7 |
| Inventive | 1 | Y | N | 2447 | 2438 | 20.40 | 3.72 | 17.0 |
| Inventive | 1 | Y | N | 2359 | 2315 | 19.17 | 3.59 | 16.6 |
| Inventive | 1 | Y | N | 2358 | 2297 | 18.72 | 3.63 | 16.2 |
| Inventive | 1 | Y | N | 2326 | 2267 | 18.38 | 3.51 | 16.3 |
| Inventive | 1 | Y | N | 2308 | 2250 | 18.18 | 3.55 | 16.1 |
| Inventive | 1 | Y | N | 2302 | 2252 | 18.59 | 3.61 | 16.4 |

Accordingly, in certain embodiments, the inventive tissue products are both durable and flexible, particularly in the cross-machine direction. For example, single ply tissue products prepared according to the present invention have geometric mean tensile strength (GMT) of about 2,000 g/3" or greater, such as about 2,200 g/3" or greater, such as about 2,400 g/3" or greater, such as from about 2,000 to about 2,600 g/3", such as from about 2,200 to about 2,500 g/3" and a Stiffness Index of about 5.0 or less, such as about 4.5 or less, such as about 4.0 or less, such as from about 3.0 to about 5.0. The relatively low degree of stiffness does not come at the expense of cross-machine direction durability. For example, the tissue products generally have CD tensile strengths of about 2,000 g/3" or greater, more preferably about 2,200 g/3" or greater and still more preferably about 2,300 g/3" or greater, such as from about 2,000 to about 2,600 g/3", such as from about 2,200 to about 2,500 g/3" and CD Stretch from about 14.0 to about 18.0 percent.

Surprisingly, the improved cross-machine direction properties may be achieved without creping the tissue web. Rather than crepe the web during manufacture, the instant tissue products may be produced by transferring a partially dewatered web to a transfer fabric having a high degree of topography to strain the nascent sheet in the cross-machine direction. In this manner, tissue products of the present invention may be manufactured by a process that employs a transfer fabric, particularly a transfer fabric that transfers the nascent tissue web from a forming fabric to a through-air drying fabric. Such fabrics may be employed in through-air drying (TAD) manufacturing processes. In particularly preferred embodiments tissue products are manufactured using a high topography transfer fabric and through-air drying fabric in an uncreped through-air dried (UCTAD) process.

Figure 4:
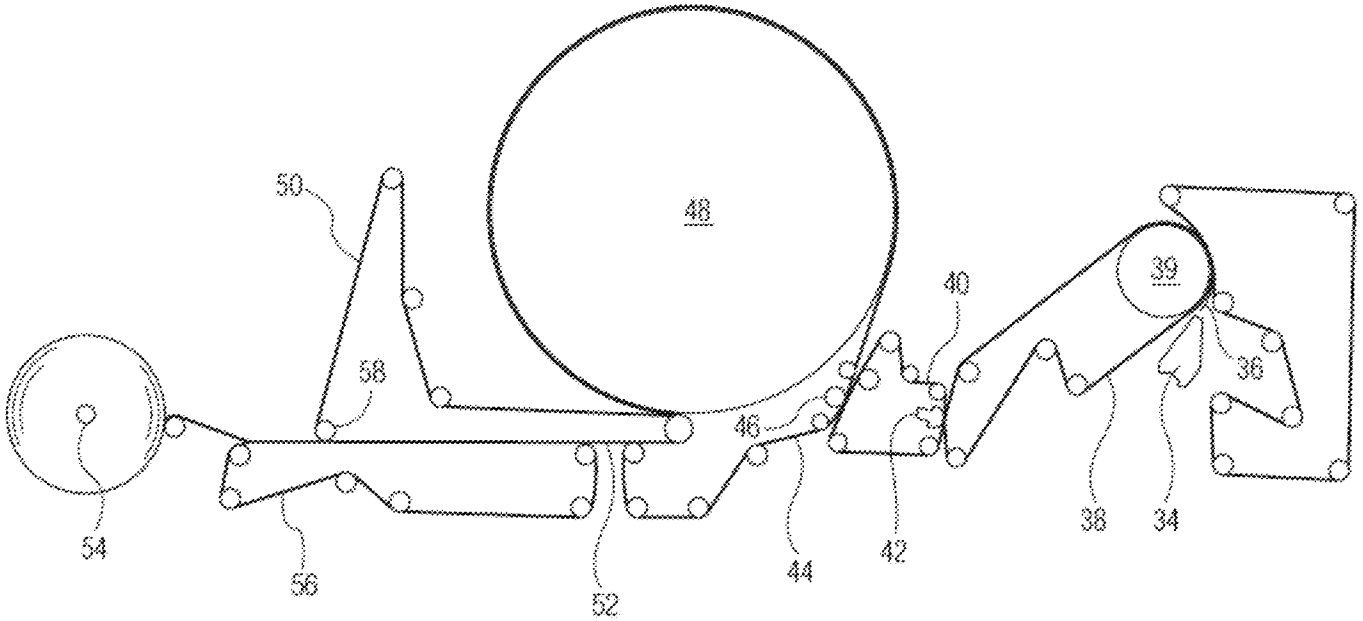
FIG. 4 illustrates one embodiment for forming a basesheet useful in the production of a tissue product according to the present invention.

With reference now to FIG. 4, a method for making through-air dried paper sheets is illustrated. Shown is a twin wire former having a papermaking headbox 34, such as a layered headbox, which injects or deposits a stream 36 of an aqueous suspension of papermaking fibers onto the forming fabric 38 positioned on a forming roll 39. The forming fabric serves to support and carry the newly-formed wet web downstream in the process as the web is partially dewatered to a consistency of about 10 dry weight percent. Additional dewatering of the wet web can be carried out, such as by vacuum suction, while the wet web is supported by the forming fabric.

The wet web is then transferred from the forming fabric to a transfer fabric 40. In one embodiment, the transfer fabric can be traveling at a slower speed than the forming fabric in order to impart increased stretch into the web. This is commonly referred to as a "rush" transfer. The relative speed difference between the two fabrics can be from 0 to 60 percent, more specifically from about 15 to 45 percent. Transfer is preferably carried out with the assistance of a vacuum shoe 42 such that the forming fabric and the transfer fabric simultaneously converge and diverge at the leading edge of the vacuum slot.

The transfer fabric preferably is a woven fabric having a relatively high degree of surface topography. The surface topography may be imparted by weaving the fabric such that the web contacting surface of the fabric has a plurality of continuous, substantially parallel, ridges separated from one another by valleys. The ridges may be oriented substantially in the machine-direction and may be straight or have a wave-like shape. In those instances where the ridges have a wave-like shape, they may be skewed slightly, such as from about 1 to about 2 degrees, relative to the machine direction. Further, the wave-like ridges may have a wavelength from about 4 to about 8 mm, such as from about 5 to about 6 mm. The upper surfaces of the ridges is preferably substantially smooth, while the valleys are smooth with small, uniform pores to facilitate draining of water from the nascent web and through the fabric.

Figure 5:
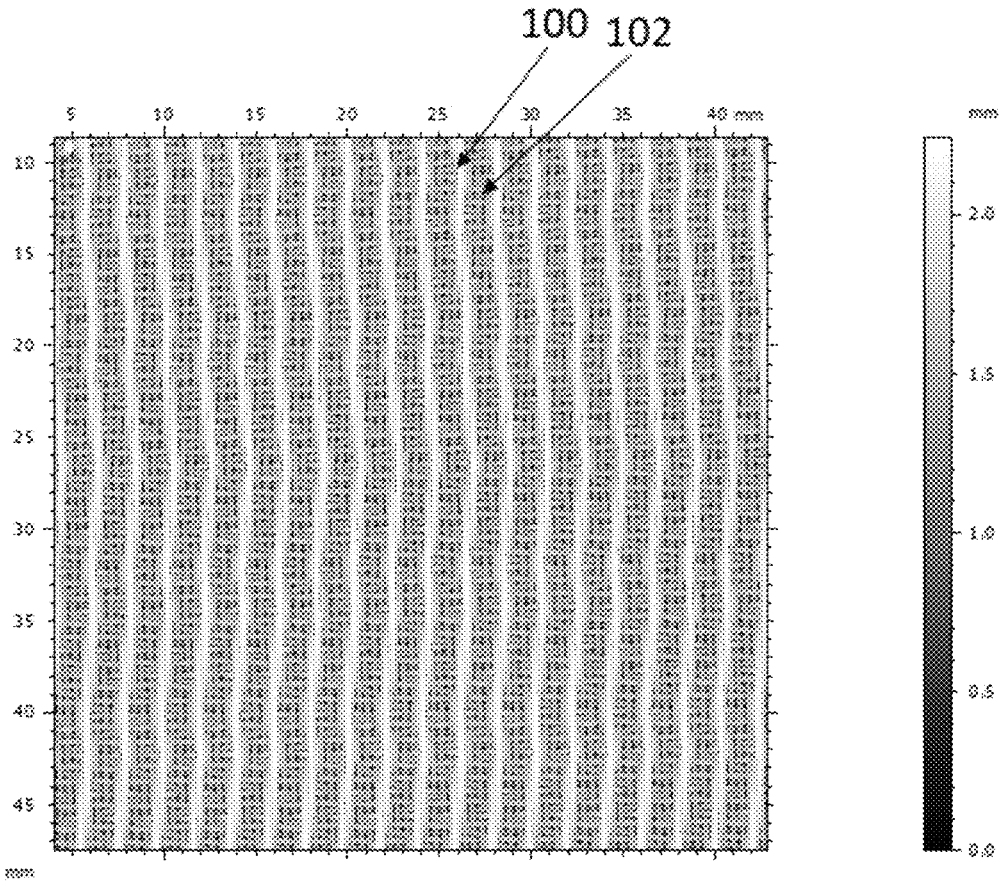
FIG. 5 is profilometry scan of a transfer fabric useful in the manufacture of tissue products according to the present invention.

A profilometry scan of one embodiment of a topographic transfer fabric useful in the present invention is shown in FIG. 5. The profilometry scan was obtained by scanning the fabric contacting surface of a fabric sample using an FRT MicroSpy® Profile profilometer (FRT of America, LLC, San Jose, Calif.) and then analyzing the image using Nanovea® Ultra software version 7.4 (Nanovea Inc., Irvine, Calif.). FIG. 5 illustrates the wave-like, substantially machine direction oriented, ridges 100 and valleys 102 disposed therebetween. The illustrated fabric was woven from warp and weft yarns having a similar diameter of about 0.30 mm. The yarns were woven to yield a fabric having valley depths, the vertical distance between the upper surface plane of the ridges and the bottom most surface plane of the web contacting surface of the fabric, of about 0.50 mm. Further, the yarns were woven to produce a plurality of substantially parallel, wave-like ridges spaced apart from one another a distance of about 2.0 mm.

Generally, transfer fabrics useful in the present invention have relatively deep valleys, such as valleys having valley depths greater than about 0.50 mm, such as from about 0.50 to about 0.70 mm. Valley depth may be measured by profilometry and is generally taken from a simulated base sheet generated by a morphological closing filter. The valley depth is measured as the difference between C2 (95 percentile height) and C1 (5 percentile height) values, having units of millimeters (mm). In certain instances, valley depth may be referred to as S90. To determine valley depth a profilometry scan of a fabric is generated and a histogram of the measured heights of the simulated base sheet is generated, and an S90 value (95 percentile height (C2) minus the 5 percentile height (C1), expressed in units of mm) is calculated.

The valley width of a given transfer fabric may vary depending on the weave pattern, however, in certain instances the valley width may be greater than about 1.5 mm and still more preferably greater than about 2.0 mm, such as from about 1.5 to about 3.5 mm. The valley width may also be measured by profilometry. Scans obtained as described above may be used to calculate the Psm value, having units of millimeters (mm).

Preferably the transfer fabrics of the present invention provide the nascent web with a relatively high degree of CD strain. Profilometry may again be used to determine the degree of CD strain imparted by the transfer fabric to the nascent web. Profilometry scans obtained as described above may be used to calculate the PLo value, which is indicative of CD strain, and is preferably at least about 15 percent, more preferably at least about 16 percent and still more preferably at least about 17 percent, such as from about 15 to about 19 percent.

With reference again to FIG. 4, the nascent web is transferred from the transfer fabric 40 to the through-air drying fabric 44 with the aid of a vacuum transfer roll 46 or a vacuum transfer shoe, optionally again using a fixed gap transfer as previously described. The through-air drying fabric can be traveling at about the same speed or a different speed relative to the transfer fabric. If desired, the through-air drying fabric can be run at a slower speed to further enhance stretch. Transfer can be carried out with vacuum assistance to ensure deformation of the sheet to conform to the through-air drying fabric, thus yielding desired bulk and imparting the web with a three-dimensional topographical pattern. Suitable through-air drying fabrics are described, for example, in U.S. Pat. Nos. 6,998,024, 7,611,607 and 10,161,084, the contents of which are incorporated herein by reference in a manner consistent with the present disclosure.

The level of vacuum used for the web transfers can be from about 3 to about 15 inches of mercury (75 to about 380 millimeters of mercury), preferably about 5 inches (125 millimeters) of mercury. The vacuum shoe (negative pressure) can be supplemented or replaced by the use of positive pressure from the opposite side of the web to blow the web onto the next fabric in addition to or as a replacement for sucking it onto the next fabric with vacuum. Also, a vacuum roll or rolls can be used to replace the vacuum shoe(s).

In certain preferred embodiments the through-air drying fabric is a woven fabric comprising a plurality of MD oriented protuberances, which may be continuous or discrete. In a particularly preferred embodiment the MD oriented protuberances are continuous and have a width of from about 0.2 to about 2.5 mm, such as from about 0.5 to about 2.0 mm and the frequency of occurrence of the MD oriented protuberances in the cross-machine direction of the fabric is from about 0.5 to about 8 per centimeter, such as from about 3.2 to about 7.9 per centimeter, such as from about 4.2 to about 5.3 per centimeter.

The MD oriented protuberances may be substantially aligned with the MD axis of the fabric or they may have a non-zero element angle. For example, the warp filaments may be woven to form protuberances extending in a continuous manner across the fabric and slightly skewed relative to the MD axis of the fabric. In this manner the MD oriented protuberances may have a non-zero element angle, such as an element angle from about 0.5 to 20 degrees, such as from about 2 to about 15 degrees, and more preferably from about 2 to about 10 degrees. In a particularly preferred embodiment, the web contacting surface of the fabric comprises a plurality of spaced apart, parallel, MD oriented protuberances having an element angle from about 2 to about 10 degrees.

In certain embodiments the MD oriented protuberances may be arranged in a continuous pattern, extending from a first lateral edge of the fabric to a second lateral edge, in which adjacent protuberances are generally parallel to one another and equally spaced apart. Between adjacent protuberances are valleys having sidewalls formed by the protuberances. In this manner, the valleys, like the protuberances, may be oriented at an angle relative to the MD axis of the fabric.

Papermaking fabrics having woven MD oriented protuberances suitable for use in the present invention may be prepared as described in U.S. Pat. Nos. 6,998,024 and 7,611,607, the contents of which are incorporated herein in a manner consistent with the present disclosure. In a particularly preferred embodiment, the MD oriented protuberances may be substantially continuous and woven from two or more warp filaments grouped together and supported by multiple shute strands of two or more diameters as disclosed in U.S. Pat. No. 7,611,607. MD protuberances woven in this manner can be oriented at an angle of from 0 to about 15 degrees relative to the true machine direction of the fabric.

The MD oriented protuberances can be configured substantially the same in terms of any one or more characteristics of height, width, length or element angle. For example, in certain embodiments, substantially all the MD oriented protuberances have substantially similar characteristics of height, width and element angle. In other embodiments however, the MD oriented protuberances may be configured such that one or more characteristics of height, width, or length of the protuberances vary from one MD oriented protuberance to another MD oriented protuberance.

In certain embodiments, in addition to MD oriented protuberances, the through-air drying fabric may comprise a plurality of second protuberances, which are generally oriented in the cross-machine direction and are preferably discrete. In particularly preferred embodiments the CD oriented protuberances are formed by topically applying a polymeric material to the woven support structure. Suitable methods of topical application include printing and extruding polymeric material onto the surface of the woven support structure. Particularly suitable polymeric materials include materials that can be strongly adhered to the woven support structure and are resistant to thermal degradation at typical tissue machine dryer operating conditions and are reasonably flexible, such as silicones, polyesters, polyurethanes, epoxies, polyphenylsulfides and polyetherketones.

In other embodiments the CD oriented protuberances may be formed by extruding a polymeric strand onto a woven support structure, such as that described in U.S. Pat. No. 6,398,910, the contents of which are incorporated herein in a manner consistent with the present discourse. In such embodiments the polymeric strand is applied so as to form a raised CD oriented protuberance above the upper most plane of the woven support structure. Alternative methods of forming the CD oriented protuberances include applying cast or cured films, weaving, embroidering or stitching polymeric fibers into the surface.

The CD oriented protuberances may be arranged on the web contacting surface of the fabric in a pattern. For example, the CD oriented protuberances may be discrete and occur in a regular, repeating pattern comprising pairs of protuberance, such as a first pair of protuberances and a second pair of protuberances, spaced apart from one another in the cross-machine direction (D1) at least about 5.0 mm and more preferably at least about 10.0 mm. Within a given pair of protuberances, the protuberances may be spaced apart a distance (D2) from about 2.0 to about 6.0 mm, such as from about 2.0 to about 5.0 mm.

In other embodiments the CD oriented protuberances may be arranged in a pattern such that each CD oriented protuberance contacts, and more preferably traverses, at least one MD oriented protuberance and in certain instances two or more adjacent MD oriented protuberances. In those embodiments where a CD protuberance contacts adjacent MD oriented protuberances, the CD protuberance may extend across the entire width of a valley and form a valley end wall.

While supported by the through-air drying fabric, the web is dried to a consistency of about 94 percent or greater by the through-air dryer 48 and thereafter transferred to a carrier fabric 50. The dried basesheet 52 is transported to the reel 54 using carrier fabric 50 and an optional carrier fabric 56. An optional pressurized turning roll 58 can be used to facilitate transfer of the web from carrier fabric 50 to fabric 56.

In one embodiment, the reel 54 can run at a speed slower than the fabric 56 in a rush transfer process for building bulk into the paper web 52. For instance, the relative speed difference between the reel and the fabric can be from about 5 to about 25 percent and, particularly from about 12 to about 14 percent. Rush transfer at the reel can occur either alone or in conjunction with a rush transfer process upstream, such as between the forming fabric and the transfer fabric.

In certain embodiments basesheets useful in forming tissue products of the present invention may comprise a single homogenous or blended layer or be multi-layered. In those instances where the basesheet is multi-layered it may comprise, two, three, or more layers. For example, the basesheet may comprise three layers such as first and second outer layers and a middle layer disposed there between. The layers may comprise the same or different fiber types. For example, the first and second outer layers may comprise short, low coarseness wood pulp fibers, such as hardwood kraft pulp fibers, and the middle layer may comprise long, low coarseness wood pulp fibers, such as northern softwood kraft pulp fibers.

In those instances where the web comprises multiple layers, the relative weight percentage of each layer may vary. For example, the web may comprise first and second outer layers and a middle layer where the first outer layer comprises from about 25 to about 35 weight percent of the layered web, the middle layer comprises from about 30 to about 50 weight percent of the layered web and the second outer layer comprises from about 25 to about 35 weight percent of the layered web. Multi-layered basesheets useful in the present invention may be formed using any number of different processes known in the art, such as the process disclosed in U.S. Pat. No. 5,129,988, the contents of which are incorporated herein in a manner consistent with the present disclosure.

In certain instances, a layer or other portion of the web, including the entire web, can be provided with wet or dry strength agents. As used herein, "wet strength agents" are materials used to immobilize the bonds between fibers in the wet state. Any material that when added to a paper web or sheet at an effective level results in providing the sheet with a wet geometric tensile strength:dry geometric tensile strength ratio in excess of 0.1 will, for purposes of this invention, be termed a wet strength agent. Typically, these materials are termed either as permanent wet strength agents or as "temporary" wet strength agents. For the purposes of differentiating permanent from temporary wet strength, permanent will be defined as those resins which, when incorporated into paper or tissue products, will provide a product that retains more than 50 percent of its original wet tensile strength after exposure to water for a period of at least five minutes. Temporary wet strength agents are those which show less than 50 percent of their original wet strength after being saturated with water for five minutes. Both classes of material find application in the present invention. The amount of wet strength agent or dry strength added to the pulp fibers can be at least about 0.1 dry weight percent, more specifically about 0.2 dry weight percent or greater, and still more specifically from about 0.1 to about 3 dry weight percent, based on the dry weight of the fibers.

Particularly preferred wet strength agents include resin binder materials selected from the group consisting of polyamide-epichlorohydrin resins, polyacrylamide resins, and mixtures thereof. Of particular utility are the various polyamide-epichlorohydrin resins. These materials are low molecular weight polymers provided with reactive functional groups such as amino, epoxy, and azetidinium groups. Particularly useful polyamide-epichlorohydrin resins include those marketed under the tradename KYMENE (Solenis, Wilmington, Del.).

Useful dry strength additives include carboxymethyl cellulose resins, starch based resins, and mixtures thereof. Examples of preferred dry strength additives include carboxymethyl cellulose, and cationic polymers from the ACCO chemical family (American Cyanamid Company of Wayne, N.J.) such as ACCO 711 and ACCO 514.

Suitable temporary wet strength resins include, but are not limited to, those resins that have been developed by American Cyanamid and are marketed under the name PAREZ™ 631 NC wet strength resin (now available from Cytec Industries, located in West Paterson, N.J.). This and similar resins are described in U.S. Pat. Nos. 3,556,932 and 3,556,933, Other temporary wet strength agents that should find application in this invention include modified starches such as those available from National Starch and marketed as CO BOND™ 1000 modified starch.

Although wet and dry strength agents as described above find particular advantage for use in connection with this invention, other types of bonding agents can also be used to provide the necessary wet resiliency. They can be applied at the wet end of the basesheet manufacturing process or applied by spraying or printing after the basesheet is formed or after it is dried.

The processes of the present invention may be useful in producing numerous and different tissue products particularly paper towels, napkins, industrial wipers, and the like. In particularly preferred embodiments the tissue products consist of a single ply comprising a permanent wet strength agent and have a basis weight in the range from about 30 to about 45 gsm, such as from about 32 to about 40 gsm.

Tissue products made according to the present invention generally have relatively high bulk such as about 12 cc/g or greater, such as about 14 cc/g or greater, such as about 16 cc/g or greater, such as from about 12 to about 22 cc/g, such as about 14 to about 22 cc/g. Generally, the products of this invention derive their sheet bulk from molding of the nascent tissue web during manufacture and do not necessarily require embossing. Nevertheless, the basesheets of this invention can be embossed to produce even greater bulk or aesthetics, if desired, or they can remain unembossed. In addition, the basesheets of this invention can be calendered to improve smoothness or decrease the bulk if desired or necessary to meet existing product specifications.

Further, the strength of the tissue products, such as the geometric mean tensile strength (GMT), may be varied depending on its intended end use. For example, the tissue products may consist of single ply, particularly an uncreped through-air dried ply, and may have a GMT of about 2,000 g/3" or greater, such as about 2,200 g/3" or greater, such as about 2,400 g/3" or greater, such as from about 2,000 to about 2,600 g/3", such as from about 2,200 to about 2,500 g/3".

TEST METHODS

Profilometry

Fabric properties are generally measured using a non-contact profilometer as described herein. To prevent any debris from affecting the measurements, all images are subjected to thresholding to remove the top and bottom 0.5 mm of the scan. To fill any holes resulting from the thresholding step and provide a continuous surface on which to perform measurements, non-measured points are filled. The image is also flattened by applying a rightness filter. Finally, a base sheet simulation is obtained using morphological filtering.

Profilometry scans of the fabric contacting surface of a sample were created using an FRT MicroSpy® Profile profilometer (FRT of America, LLC, San Jose, Calif.) and then analyzing the image using Nanovea® Ultra software version 7.4 (Nanovea Inc., Irvine, Calif.). Samples were cut into squares measuring 145×145 mm. The samples were then secured to the x-y stage of the profilometer using an aluminum plate having a machined center hole measuring 2×2 inches, with the fabric contacting surface of the sample facing upwards, being sure that the samples were laid flat on the stage and not distorted within the profilometer field of view.

Once the sample was secured to the stage the profilometer was used to generate a three-dimensional height map of the sample surface. A 1602×1602 array of height values were obtained with a 30 μm spacing resulting in a 48 mm MD×48 mm CD field of view having a vertical resolution 100 nm and a lateral resolution 6 μm. The resulting height map was exported to .sdf (surface data file) format.

Individual sample .sdf files were analyzed using Nanovea® Ultra version 7.4 by performing the following functions:

(1) Using the "Thresholding" function of the Nanovea® Ultra software the raw image (also referred to as the field) is subjected to thresholding by setting the material ratio values at 0.5 to 99.5 percent such that thresholding truncates the measured heights to between the 0.5 percentile height and the 99.5 percentile height;

(2) Using the "Fill in Non-Measured Points" function of the Nanovea® Ultra software the non-measured points are filled by a smooth shape calculated from neighboring points;

(3) Using Robust Gaussian filter roughness filter with a cut off wavelength of 24.0 mm and selecting "manage end effects";

(4) Using the "Morphilogical Filtering" selecting "closing filter and a structuring element of a sphere with a 1.7 mm diameter";

(5) Using the "Abbott-Firestone Curve" study function of the Nanovea® Ultra software an Abbott-Firestone Curve is generated from which "interactive mode" is selected and a histogram of the measured heights is generated, from the histogram an S90 value (95 percentile height (C2) minus the 5 percentile height (Cl), expressed in units of mm) is calculated.

(6) Using "convert surface into series of profiles" and data from "parameters table".

Based upon the foregoing, three values, indicative of the fabric topography are reported—valley depth, valley width and strain. Valley width is the Psm value having units of millimeters (mm). Valley depth is the difference between C2 and C1 values and has units of millimeters (mm). In certain instances, pocket depth may be referred to as S90. Strain is the PLo value having units of percent (%).

Basis Weight

Prior to testing, all samples are conditioned under TAPPI conditions (23±1° C. and 50±2 percent relative humidity) for a minimum of 4 hours. Basis weight of sample is measured by selecting twelve (12) products (also referred to as sheets) of the sample and making two (2) stacks of six (6) sheets. In the event the sample consists of perforated sheets of bath or towel tissue, the perforations must be aligned on the same side when stacking the usable units. A precision cutter is used to cut each stack into exactly 10.16×10.16 cm (4.0×4.0 inch) squares. The two stacks of cut squares are combined to make a basis weight pad of twelve (12) squares thick. The basis weight pad is then weighed on a top loading balance with a minimum resolution of 0.01 grams. The top loading balance must be protected from air drafts and other disturbances using a draft shield. Weights are recorded when the readings on the top loading balance become constant. The mass of the sample (grams) per unit area (square meters) is calculated and reported as the basis weight, having units of grams per square meter (gsm).

Caliper

Caliper is measured in accordance with TAPPI Test Method T 580 pm-12 "Thickness (caliper) of towel, tissue, napkin and facial products." The micrometer used for carrying out caliper measurements is an Emveco 200-A Tissue Caliper Tester (Emveco, Inc., Newberg, Oreg.). The micrometer has a load of 2 kilo-Pascals, a pressure foot area of 2,500 square millimeters, a pressure foot diameter of 56.42 millimeters, a dwell time of 3 seconds and a lowering rate of 0.8 millimeters per second.

Tensile

Tensile testing is conducted on a tensile testing machine maintaining a constant rate of elongation and the width of each specimen tested is 3 inches. Testing is conducted under TAPPI conditions. More specifically, samples for dry tensile strength testing were prepared by conditioning under TAPPI conditions for at least 4 hours and then cutting a 3±0.05 inch (76.2±1.3 mm) wide strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333) or equivalent. The instrument used for measuring tensile strengths was an MTS Systems Sintech 11S, Serial No. 6233. The data acquisition software was MTS TestWorks® for Windows Ver. 3.10 (MTS Systems Corp., Research Triangle Park, N.C.). The load cell was selected from either a 50 Newton or 100 Newton maximum, depending on the strength of the sample being tested, such that the majority of peak load values fall between 10 to 90 percent of the load cell's full-scale value. The gauge length between jaws was 4±0.04 inches (101.6±1 mm) for facial tissue and towels and 2±0.02 inches (50.8±0.5 mm) for bath tissue. The crosshead speed was 10±0.4 inches/min (254±1 mm/min), and the break sensitivity was set at 65 percent. The sample was placed in the jaws of the instrument, centered both vertically and horizontally. The test was then started and ended when the specimen broke. The peak load was recorded as either the "MD tensile strength" or the "CD tensile strength" of the specimen depending on direction of the sample being tested. Ten representative specimens were tested for each product or sheet and the arithmetic average of all individual specimen tests was recorded as the appropriate MD or CD tensile strength having units of grams per three inches (g/3"). Tensile energy absorbed (TEA) and slope are also calculated by the tensile tester. TEA is reported in units of $g \cdot cm/cm^2$ and slope is recorded in units of kilograms (kg). Both TEA and Slope are directionally dependent and thus MD and CD directions are measured independently. All products were tested in their product forms without separating into individual plies.

Example

Basesheets were made using a through-air dried papermaking process commonly referred to as "uncreped through-air dried" ("UCTAD") and generally described in U.S. Pat. No. 5,607,551, the contents of which are incorporated herein in a manner consistent with the present disclosure. The basesheets were then converted by calendering, slitting and winding to yield single ply tissue products.

In all cases basesheets were produced from a furnish comprising northern softwood kraft (NSWK) and *Eucalyptus* hardwood kraft (EHWK) using a layered headbox fed by three stock pumps such that the webs having three layers (two outer layers and a middle layer) were formed. The two outer layers comprised EHWK (each layer comprising 20 wt % of the tissue web) and the middle layer comprised NSWK (middle layer comprised 60 wt % of the tissue web). Strength was controlled via the addition of carboxymethylcellulose (CMC) and permanent wet strength resin, and/or by refining the furnish.

TABLE 2

| Sample | Fabric Layer Furnish (wt %) | Middle Layer Furnish (wt %) | Air Layer Furnish (wt %) | Permanent Wet Strength (kg/MT) | Dry Strength (kg/MT) |
|---|---|---|---|---|---|
| Control Basesheet | 31.5 | 37 | 31.5 | 5 | 1.7 |
| Inventive Basesheet | 30 | 40 | 30 | 10 | 3.3 |

Each furnish was diluted to approximately 0.2 percent consistency and delivered to a layered headbox and deposited on a Voith Fabrics TissueForm V forming fabric (commercially available from Voith Fabrics, Appleton, Wis.). The wet web was vacuum dewatered to approximately 25 percent consistency and then transferred to a transfer fabric. Inventive samples were transferred to the fabric depicted in FIG. 5 and described further in Table 3, below. The transfer fabric used to produce the control samples is also described in Table 3, below. Both transfer fabrics are commercially available from Voith Fabrics, Appleton, Wis.

TABLE 3

| | S90 (mm) | Psm (mm) | PLo (%) | Air Permeability (CFM) | Fabric Caliper (mm) | MD Oriented Ridges per 48 mm |
|---|---|---|---|---|---|---|
| Inventive | 0.56 | 2.03 | 18.0 | 360 | 1.46 | 24 |
| Control | 0.66 | 2.66 | 15.8 | 479 | 1.71 | 18 |

The web was transferred from the transfer fabric to a through-air drying fabric substantially as described in co-pending U.S. patent application Ser. No. 16/205,355, the contents of which are incorporated herein in a manner consistent with the present disclosure. The through-air drying fabric consisted of a woven base fabric (t1205-2 woven fabric, commercially available from Voith Fabrics, Appleton, Wis. and previously described in U.S. Pat. No. 8,500,955). The woven base fabric had a plurality of spaced apart substantially continuous machine direction (MD) oriented protuberances that defined plurality of valleys there between. The fabric further comprised a plurality of discrete, non-woven, cross-machine direction (CD) oriented protuberances. The discrete, non-woven, cross-machine direction (CD) oriented protuberances comprised a silicone printed onto the base fabric and covered approximately 7.5 percent of the web contacting surface of the fabric.

The nascent web was rush transferred to the through-air drying fabric at a rush transfer rate of 24 percent. The web was through-air dried while supported by the through-air drying fabric to yield a basesheet having a geometric mean tensile (GMT) of about 1,100 g/3", a basis weight of about 40 gsm. The basesheet was subjected to various calender loads, slit and wound into single ply rolled tissue products. More particularly, the dried basesheet was calendered using two calender units, the first comprising a patterned steel roll and a 40 P&J polyurethane roll and the second comprising a patterned steel roll and a 4 P&J polyurethane roll. The calenders were configured substantially as described in U.S. Pat. No. 10,040,265, the contents of which are incorporated herein in a manner consistent with the present invention. Loading of the first calender was about 6 pounds per linear inch (pli) and loading of the second calender ranged from about 23 to about 32 pli. The products were subject to physical testing as summarized in Tables 4 and 5, below.

TABLE 4

| Sample | Basis Wt. (gsm) | Caliper (μm) | Sheet Bulk (cc/g) | GMT (g/3") | GM Slope (kg) | GM Stretch (%) | Stiffness Index |
|---|---|---|---|---|---|---|---|
| Control | 33.8 | 780 | 23.1 | 2325 | 8.6 | 15.9 | 3.71 |
| Inventive 1 | 33.7 | 879 | 26.0 | 905 | 8.2 | 17.3 | 3.35 |
| Inventive 2 | 33.3 | 858 | 25.8 | 807 | 7.9 | 17.2 | 3.36 |
| Inventive 3 | 33.4 | 836 | 25.1 | 766 | 8.1 | 16.7 | 3.44 |
| Inventive 4 | 33.4 | 849 | 25.5 | 770 | 7.9 | 16.8 | 3.40 |
| Inventive 5 | 33.4 | 787 | 23.6 | 744 | 7.9 | 16.8 | 3.43 |

TABLE 5

| Sample | CD Tensile (g/3") | CD TEA (g · cm/cm$^2$) | CD Stretch (%) | CD Slope (kg) | CD TEA Index |
|---|---|---|---|---|---|
| Control | 2245 | 17.18 | 13.8 | 4.85 | 7.65 |
| Inventive 1 | 2438 | 19.17 | 17.0 | 3.72 | 8.37 |
| Inventive 2 | 2315 | 18.72 | 16.6 | 3.59 | 8.28 |
| Inventive 3 | 2297 | 18.38 | 16.2 | 3.63 | 8.15 |
| Inventive 4 | 2267 | 18.18 | 16.3 | 3.51 | 8.11 |
| Inventive 5 | 2250 | 18.59 | 16.1 | 3.55 | 8.08 |

Embodiments

First embodiment: A rolled tissue product comprising a single ply tissue web spirally wound about a core, the web having a cross-machine direction (CD) tensile of about 2,200 g/3" or greater and a CD Stretch of about 14.0 percent or greater.

Second embodiment: The product of the first embodiment wherein the single-ply tissue web has a GMT from about 2,000 to about 2,500 g/3" and a geometric mean stretch (GM Stretch) of about CD Stretch from about 14.0 to about 18.0 percent.

Third embodiment: The product of embodiments 1 or 2 wherein the single-ply tissue web has a CD TEA of about 18.0 g·cm/cm$^2$ or greater.

Fourth embodiment: The product of any one of embodiments 1 through 3 wherein the single-ply tissue web has a GM Slope from about 3.0 to about 5.0.

Fifth embodiment: The product of any one of embodiments 1 through 4 wherein the single-ply tissue web has a Stiffness Index of about 5.0 or less.

Sixth embodiment: The product of any one of embodiments 1 through 5 wherein the single-ply tissue web has a CD Stretch from about 15.0 to about 18.0 percent.

Seventh embodiment: The product of any one of embodiments 1 through 6 wherein the single-ply tissue web has a CD Tensile from about 2,200 to about 2,600 g/3".

Eighth embodiment: The product of any one of embodiments 1 through 7 wherein the single-ply tissue web has a basis weight from about 32 to about 40 grams per square meter (gsm) and a sheet bulk of about 14.0 cubic centimeters per gram (cc/g) or greater.

Ninth embodiment: The product of any one of embodiments 1 through 8 wherein the single-ply tissue web has a basis weight from about 34 to about 38 grams per square meter (gsm) and a sheet bulk from about 14.0 to about 20 cc/g.

Tenth embodiment: The product of any one of embodiments 1 through 9 wherein the single-ply tissue web has a CD Tensile from about 2,200 to about 2,600, a CD Stretch from about 14.0 to about 18.0 percent and CD TEA from about 18.0 to about 21.0 g·cm/cm$^2$.

Eleventh embodiment: The product of any one of embodiments 1 through 10 wherein the web is through-air dried.

Twelfth embodiment: The product of any one of embodiments 1 through 11 wherein the web is uncreped.

What is claimed is:

1. A rolled tissue product comprising a single ply tissue web spirally wound about a core, the single ply web consisting essentially of wood pulp fibers and having a cross-machine direction (CD) tensile of about 2,200 g/3" or greater and a CD Stretch of about 14.0 percent or greater.

2. The rolled tissue product of claim 1 wherein the single ply web has a GMT from about 2,000 to about 2,500 g/3" and a CD Stretch from about 14.0 to about 18.0 percent.

3. The rolled tissue product of claim 1 wherein the single ply web has a CD TEA of about 18.0 g·cm/cm$^2$ or greater.

4. The rolled tissue product of claim 1 wherein the single ply web has a GM Slope from about 3.0 to about 5.0.

5. The rolled tissue product of claim 1 wherein the single ply web has a Stiffness Index less than about 5.0.

6. The rolled tissue product of claim 1 wherein the single ply web has a CD Tensile from about 2,200 to about 2,600 g/3" and a CD Stretch from about 15.0 to about 18.0 percent.

7. The rolled tissue product of claim 1 wherein the single ply web has a basis weight from about 32 to about 40 grams per square meter (gsm) and a sheet bulk of about 14.0 cubic centimeters per gram (cc/g) or greater.

8. A rolled tissue product comprising a spirally wound uncreped single ply tissue web consisting essentially of wood pulp fibers and having a basis weight from 32 to about 40 grams per square meter (gsm), a GMT from about 2,000 to about 2,500 g/3" and CD Stretch of about 15.0 percent or greater.

9. The rolled tissue product of claim 8 wherein the uncreped single ply web has a CD TEA of about 18.0 g·cm/cm$^2$ or greater.

10. The rolled tissue product of claim 8 wherein the uncreped single ply web has a GM Slope from about 3.0 to about 5.0.

11. The rolled tissue product of claim 8 wherein the uncreped single ply web has a Stiffness Index less than about 5.0.

12. The rolled tissue product of claim 8 wherein the uncreped single ply web has a CD Tensile from about 2,200 to about 2,600 g/3" and a CD Stretch from about 15.0 to about 18.0 percent.

13. The rolled tissue product of claim 8 wherein the uncreped single ply web has a basis weight from about 32 to about 40 grams per square meter (gsm) and a sheet bulk of about 14.0 cubic centimeters per gram (cc/g) or greater.

14. A rolled tissue product comprising a spirally wound uncreped and through-air dried single ply tissue web consisting essentially of wood pulp fibers and having a basis weight of about 34 gsm or greater, a sheet bulk of about 14.0 cubic centimeters per gram (cc/g) or greater, a CD Tensile from about 2,200 to about 2,600 g/3" and a CD Stretch from about 15.0 to about 18.0 percent.

15. The rolled tissue product of claim 14 wherein the single ply web has a CD TEA of about 18.0 g·cm/cm$^2$ or greater.

16. The rolled tissue product of claim 14 wherein the single ply web has a GM Slope from about 3.0 to about 5.0.

17. The rolled tissue product of claim 14 wherein the single ply web has a Stiffness Index less than about 5.0.

18. The rolled tissue product of claim 14 wherein the single ply web has a CD TEA from about 18.0 to about 21.0 g·cm/cm$^2$.

19. The rolled tissue product of claim 14 wherein the single ply web has a basis weight from about 34 to about 40 gsm and a sheet bulk from about 14 to about 20 cc/g.

20. The rolled tissue product of claim 19 having a CD TEA Index of about 8.0 or greater.

* * * * *